United States Patent [19]

Dudney

[11] Patent Number: 5,009,622

[45] Date of Patent: Apr. 23, 1991

[54] COOLING SYSTEMS FOR MARINE MOTORS

[76] Inventor: Frank A. R. Dudney, P.O. Box 413, Paarden Eiland, Cape Town, Cape Province, South Africa

[21] Appl. No.: 491,867

[22] Filed: Mar. 12, 1990

[30] Foreign Application Priority Data

Mar. 15, 1989 [ZA] South Africa ..... 89/1964

[51] Int. Cl.[5] ..... B63H 21/10

[52] U.S. Cl. ..... 440/88; 165/44; 165/51

[58] Field of Search ..... 440/88; 165/41, 44, 165/51

[56] References Cited

U.S. PATENT DOCUMENTS

| | | | |
|---|---|---|---|
| 366,662 | 7/1887 | Harthan | 440/88 |
| 1,446,775 | 2/1923 | Wahl | 440/88 |
| 2,386,803 | 10/1945 | Jutte | 440/88 |
| 2,682,852 | 7/1954 | Ruffolo | 165/44 |
| 2,976,834 | 3/1961 | Waldron et al. | 165/44 |
| 3,240,179 | 3/1966 | Van Ranst | 440/88 |
| 3,476,070 | 11/1969 | Austen | 440/88 |
| 4,260,011 | 4/1981 | Brown | 165/51 |
| 4,320,798 | 3/1982 | Obernberger | 165/51 |
| 4,768,580 | 9/1988 | Ferguson | 165/41 |

FOREIGN PATENT DOCUMENTS

| | | | |
|---|---|---|---|
| 211197 | 9/1986 | Japan | 440/88 |

*Primary Examiner*—Sherman Basinger
*Assistant Examiner*—Thomas J. Brahan

[57] ABSTRACT

A cooling system has a coolant path which is external to the motor housing of the motor. The external coolant path is connected across the inlet and outlet of the internal coolant path through which coolant is normally conveyed to cool the hot zones of the motor. A closed circuit is thus formed. The external coolant path includes a heat exchanger arranged to place the coolant in heat exchange relationship with water in which the motor runs. It may also include a header tank for pressure control and topping up purposes. The external path can be in kit form for conversion of existing motors. The motor may be an inboard or outboard motor.

8 Claims, 2 Drawing Sheets

COOLING SYSTEMS FOR MARINE MOTORS

BACKGROUND OF THE INVENTION

This invention relates to cooling systems for marine outboard and inboard motors.

The cooling systems of marine motors are normally dependent on the intake, into the motor, of salt or fresh water to ensure that the motor runs at an even temperature. It will be appreciated that the often corrosive nature of the water, particularly salt water, and dirt in the water may give rise to various problems. These problems center around the fact that intake inlets can easily be blocked, cutting off the cooling water supply and thermostats in the intake cooling system may deteriorate with corrosion, significantly varying the engine temperature. In addition, water pump impellers tend to deteriorate as a result of corrosion and the intake of dirt and may even burn out if cooling water flow through the system is restricted. Also, salt water and slit cause corrosion throughout the cooling system and fresh water flusing after each use of the motor is required to reduce this problem.

SUMMARY OF THE INVENTION

The invention provides a cooling system for a marine motor having motor and drive housings and an internal coolant path for conveying a liquid coolant through hot zones of the motor, the internal coolant path having an inlet and an outlet, the cooling system comprising a coolant path which is external to the motor housing, which is connectable across the inlet and the outlet and which forms, with the internal coolant path, a closed coolant circuit, the external coolant path including a heat exchanger located so as to be underwater in use of the system.

Preferably, the external coolant path is in the form of a kit connectable to the motor to convert it for use with the closed coolant circuit. Alternatively, at least certain components of the external coolant path are formed integrally with the motor or drive housing.

The system may include a header tank in the external coolant path for use in replenishing the closed circuit and for maintaining an appropriate coolant pressure in the closed circuit.

To convert an existing motor, the existing water intake system of the motor could be disconnected from the raw water or liquid coolant inlet and outlets and the system of the invention could be installed on the motor.

The raw liquid intake could be connected to an injector which is adapted to inject intake water from, for instance, the pitot orifice of the motor or drive housing, into the exhaust of the motor, thereby cooling the exhaust when the motor is operating at high revolutions.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWING

The present invention will become more fully understood from the detailed description given hereinbelow and the accompanying drawings which are given by way of illustration only, and thus, are not limitative of the present invention, and wherein.

DESCRIPTION OF AN EMBODIMENT OF THE INVENTION

Figure 1:
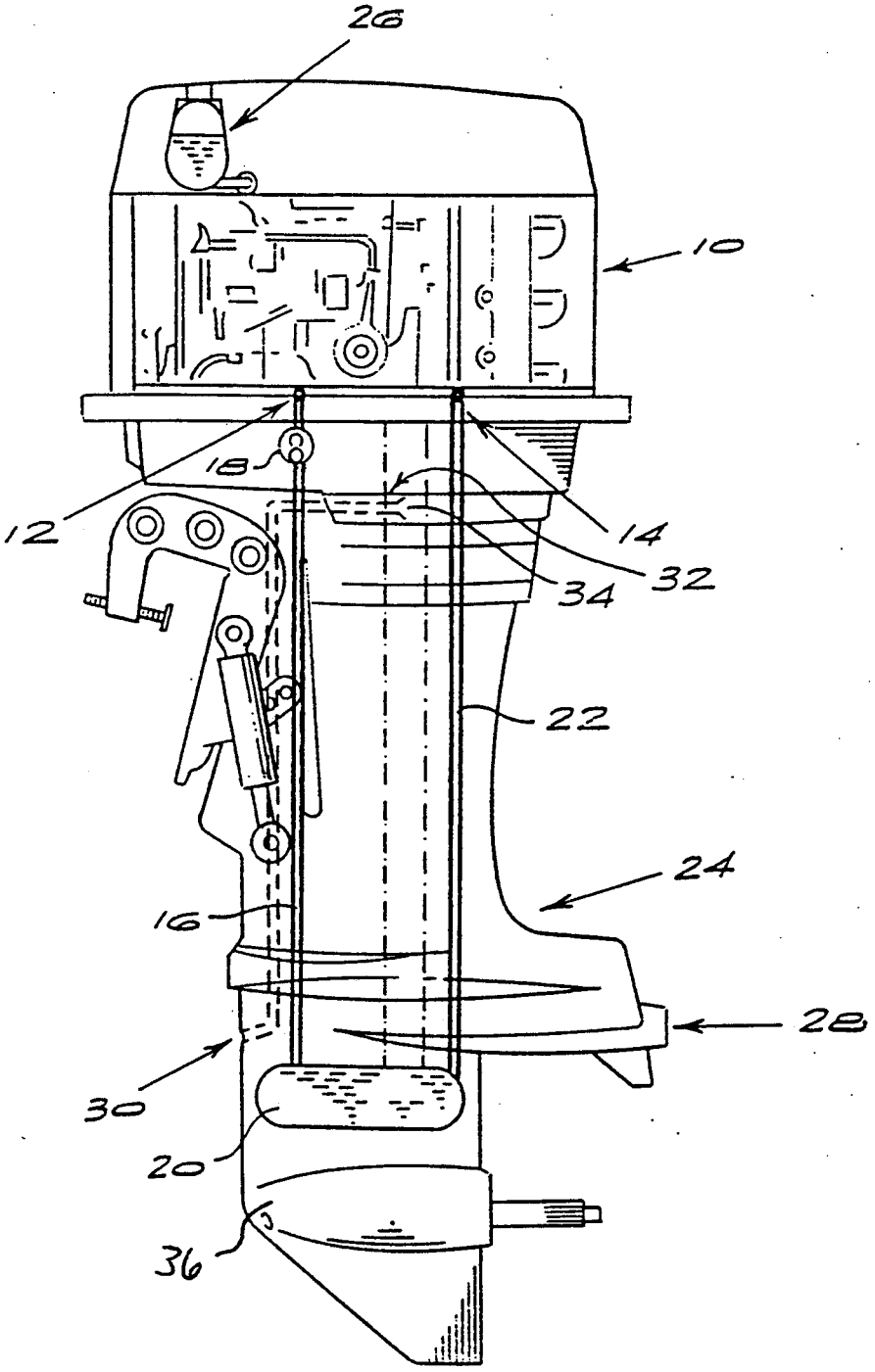
FIG. 1 illustrates, diagrammatically, an outboard motor with the cooling system of a first embodiment of the invention.
Figure 2:
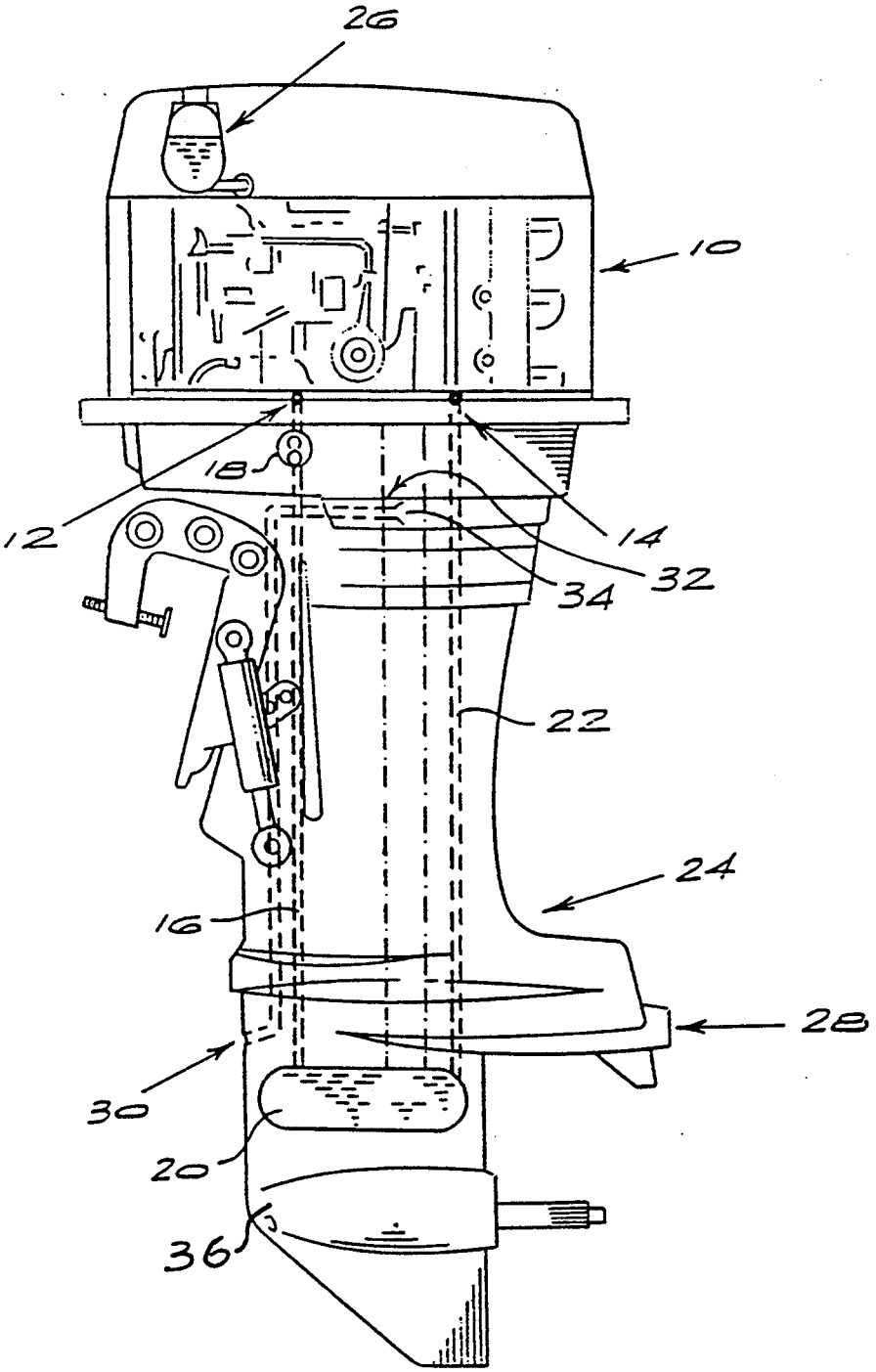
FIG. 2 illustrates, diagrammatically, an outboard motor with the cooling system of a second embodiment of the invention.

The outboard motor 10 illustrated in FIGS. 1 and 2 includes, a standard, internal liquid coolant path through the hot parts of the engine block of the motor. This path (not visible in drawings) has an outlet 12 and an inlet 14 to allow the connection thereto of an external closed liquid coolant path as will be described below.

The closed external liquid coolant path includes a heated conduit 16 connected to the outlet 12 via a pump 18, and a cooled coolant conduit 22 connected to the inlet 14. From the conduit 16, the coolant is pumped through a heat exchanger labyrinth 20 which is located on an underwater part of the drive housing 24 to be cooled by heat exchange with the surrounding water. The cooled coolant is pumped through the conduit 22 into the motor 10 via inlet 14. A gear box 36 is provided below the heat exchanger labyrinth 20 for mounting a propeller.

A header tank 26 is provided, in liquid communication with the path constituted by the conduit 16, heat exchanger labyrinth 20 and conduit 22, to ensure that an appropriate system pressure is maintained in the closed coolant path and also to provide a convenient means of refilling the system with coolant.

In an alternative arrangement the heat exchanger could be incorporated in the cavitation plate 28 in those systems that are integral with the motor and drive casting.

In the preferred form of the invention, the conduits 16 and 22, the heat exchanger 20 and the header tank 26 are supplied in the form of a conversion kit by means of which an existing marine motor can be converted to use in accordance with the invention as shown in FIG. 1. However, it is also possible for at least the conduits, and possibly also the heat exchanger, to be incorporated in the drive housing casting 24 at the manufacturing stage as indicated in FIG. 2. Of course, for proper operation of the heat exchanger it must be in heat exchange relationship with the ambient water even if formed as an integral part of the drive housing.

The coolant which flows in the closed circuit constituted by the internal coolant path and the path made up of the conduits 16 and 22 and the heat exchanger can be fresh water with or without conventional additives designed to improve its heat absorption and other characteristics. Alternatively, the coolant could be any one of a number of conventionally available oils or other liquids commonly used for heat transfer purposes.

In the drawings, the conventional water intake orifice 30 is coupled at 32 to a jet 34 oriented to spray water, during operations, into the exhaust from the motor. A suitable control can be included to ensure that this facility operates only at high engine speeds rather than continuously when the motor is running water.

An advantage of the closed circuit cooling system described above is the fact that internal corrosion is reduced and the motor only needs external rinsing after use. Another advantage resides in the fact that it is possible to start and warm up the motor before the vessel is launched. This permits the motor to be tested before launching and could overcome motor failures which could occur on the open water with an untested motor.

The invention being thus described, it wil be obvious that the same may be varied in many ways. Such variations are not to be regared as a departure from the spirit and scope of the invention, and all such modifications as would be obvious to one skilled in the art are intended to be included within the scope of the following claims.

I claim:

1. A cooling system for an outboard marine motor having motor and drive housing with a lower gear box and a cavitation plate above said gear box, and an internal coolant path for conveying a liquid coolant through hot zones of the motor, the internal coolant path having an inlet and an outlet, the cooling system comprising a coolant path which is external to the motor housing and connectable across the inlet and the outlet to form with the internal coolant path, a closed coolant circuit, the external coolant path including a heat exchanged located between said cavitation plate and said gearbox so as to be under water in which the motor moves during use of the system, the external coolant path being adjacent the drive housing, and the cooling system being free of operative contact with said gear box external to the motor housing whereby the cooling system primarily cools the motor.

2. The cooling system according to claim 1, wherein the external coolant path is a kit connectable to the motor to convert it for use with the closed coolant circuit.

3. The cooling system according to claim 1, wherein said at least certain components of the external coolant path are formed integrally with the motor.

4. The cooling system according to claim 1, further comprising a header tank in the external coolant path for use in replenishing the closed circuit and for maintaining an appropriate coolant pressure in the closed circuit.

5. The cooling system according to claim 1, wherein the heat exchanger is mounted in use on the drive housing of the motor.

6. The cooling system according to claim 1, wherein at least certain componets of the external coolant path are formed integrally with the drive housing.

7. The cooling system according to claim 1, wherein the external coolant path further comprises a descending conduit and an ascenting conduit which are both external to and in substantially continuous contact with the drive housing.

8. The cooling system according to claim 1, wherein the external coolant path further comprises a descending conduit and an ascending conduit located within the drive housing.

* * * * *